United States Patent [19]

Meyer

[11] Patent Number: 4,590,632

[45] Date of Patent: May 27, 1986

[54] MATTRESS FOR ACCOMMODATING BEDPAN OR THERAPEUTIC DEVICE

[76] Inventor: Benjamin S. Meyer, 229 Richmar Dr., Birmingham, Ala. 35213

[21] Appl. No.: 653,745

[22] Filed: Sep. 24, 1984

[51] Int. Cl.[4] ..... A47C 27/00; A61G 7/02

[52] U.S. Cl. ..... 5/462; 5/463; 5/90

[58] Field of Search ..... 5/462–465, 5/90

[56] References Cited

U.S. PATENT DOCUMENTS

| | | | |
|---|---|---|---|
| 1,295,770 | 2/1919 | Lamont | 5/462 |
| 1,529,790 | 3/1925 | Howard | 5/463 |
| 2,810,920 | 10/1957 | Carruth | 5/462 |
| 3,419,920 | 1/1969 | Maddux, Jr. et al. | 5/463 |
| 3,521,311 | 7/1970 | Cohen | 5/465 |
| 3,731,327 | 5/1973 | Frey | 5/465 |
| 4,091,480 | 5/1978 | Oxenburg | 5/463 |
| 4,244,066 | 1/1981 | Rukawina | 5/463 |
| 4,290,155 | 9/1981 | Hanson | 5/465 |

*Primary Examiner*—Kenneth J. Dorner
*Assistant Examiner*—Michael F. Trettel
*Attorney, Agent, or Firm*—Fleit, Jacobson, Cohn & Price

[57] ABSTRACT

A mattress system made of two superimposed mattresses with the top one cut out and receiving a removable drawer held in position by a Velcro tensioning strap. The drawer has a front pocket to stuff to increase tension whenever necessary.

3 Claims, 1 Drawing Figure

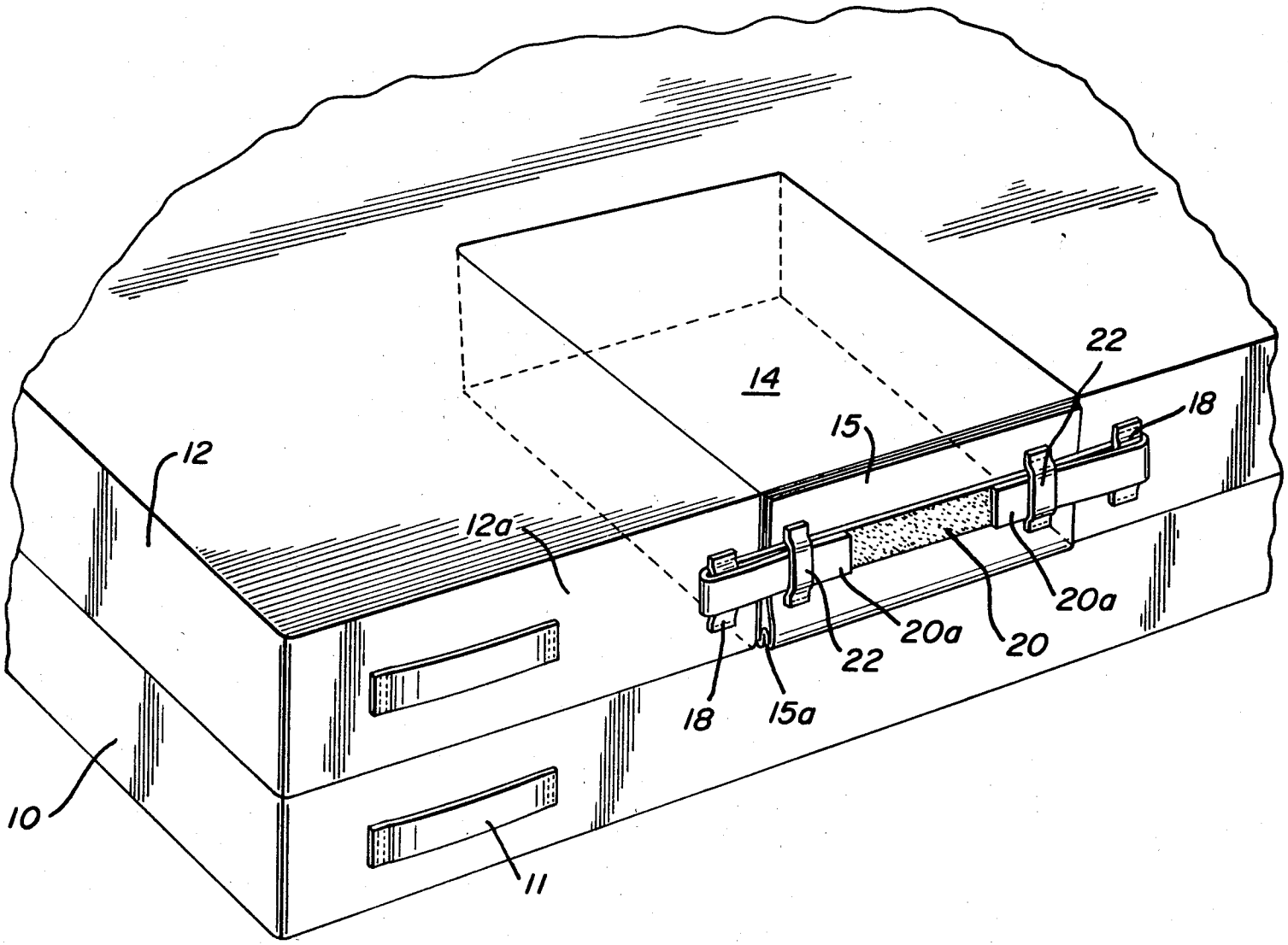
18
22
20a
20
20a
22
15
15a
14
18
12a
11
12
10

MATTRESS FOR ACCOMMODATING BEDPAN OR THERAPEUTIC DEVICE

This invention relates to a two-part mattress system to facilitate use of a bedpan or therapeutic devices under the buttocks of a bed-ridden patient.

BACKGROUND OF THE INVENTION

A number of ideas have been advanced in connection with the subject of this invention, but thus far no mattress system has been devised that successfully enables a bedpan to be used by a patient easily and comfortably and also deals effectively with decubitus ulcers.

It is the object of the present invention to provide a mattress system that will fill this absent need in the art.

SUMMARY OF THE INVENTION

The present invention provides a two-part mattress system, wherein the mattress is divided into two horizontal superimposed parts, the upper part being provided with a pullout section with provision to maintain the pullout section integral with the upper section of the mattress and thereby maintain its uppersurface continuity.

BRIEF DESCRIPTION OF THE DRAWING

The sole FIGURE illustrates the novel inventive mattress of the present invention.

DESCRIPTION OF PREFERRED EMBODIMENT

As will be evident from the sole FIGURE, the mattress system comprises a lower rectangular mattress body 10, having a width and length corresponding to the desired horizontal dimensions of the overall mattress system. An upper rectangular mattress body 12, also of the same dimensions, is superimposed upon the mattress body 10. The two mattress bodies 10 and 12 are made of any suitable materials, such as a foamed polyurethane or the like, or of an inner spring construction, and are covered with an appropriate ticking, suitable for hospital use. Each is provided with loops 11 sewn or fixed in the four corners of the mattress body in order to provide carrying straps to transport the mattress bodies. Preferably, mattress body 10 is considerably thinner or of less height than mattress body 12 and may be as thin as one or two inches in height. Mattress body 12, which is the main mattress portion, is of substantial thickness or height, such as is customarily useable in hospitals and has a height sufficient to receive a typical bedpan.

Mattress body 12 is provided with a rectangular cutout or drawer 14, which cutout section or drawer 14 is slidable to a retracted position or removable from mattress body 12. When removed, or slid out, a rectangular recess or cutout is defined by mattress body 12, into which a bedpan or therapeutic device can be placed. Cutout 14 is supported on and slides on the mattress body 10, which serves as a bottom sliding pad and, therefore, its removal, retraction and replacement is greatly facilitated. Cutout or drawer 14 may contain air pockets or be provided with a porous surface and provision for introducing fluid through its pores.

The front of the cutout or drawer 14 is provided with a pockek 15, the bottom portion of which has a series of longitudinally extending folds to allow for expansion of the pocket 15 in a direction away from the drawer or cutout 14. Loops 18 are sewn or otherwise fixed to the longitudinal edge 12 (*a*) of the mattress body 12 on either side of the drawer or cutout 14. A long binding strap 20, consisting of a Velcro strap, passes through the loops 18 with its ends folded over to the outside and returned through loops 22, sewn or attached to the outer surface of the pocket 15. The ends 20(*a*) of the Velcro strap are attached to the body of the strap 20 under suitable tension to maintain cutout 14 in its recess in mattress portion 12. If additional pressure is needed to maintain cutout 14 in its recess so that the upper surface of the mattress portion 12 presents a continuous supporting surface, towels or the like can be stuffed into the pocket 15. The strap 20 is extra long, so that when the cutout 14 or drawer is slid out of its recess, the strap 20 is still attached through the loops 18. This facilitates repositioning or sliding in of the cutout or drawer 14.

Although the construction is quite simple in character, the construction is effective and efficient.

What is claimed is:

1. A mattress system comprising two superimposed elongated generally rectangular in cross section mattress bodies having longitudinal and transverse axes, the lower said body serving as a support for the upper body, said upper body defining a cutout extending from one of its long edges, a drawer having complementary dimensions received in said cutout and slidable on said lower mattress body so said upper body and drawer fully received in said cutout together constitute a continuous upper supporting surface, expansion means on the front of said drawer and detachable tension means pressing against said drawer and expansion means to force said drawer into said outout to maintain the continuous upper supporting surface while allowing said drawer to be pulled out partially or fully by sliding on said lower mattress body, said expansion means being comprised of a pocket pleated at the bottom to allow expansion of the pocket.

2. A mattress system according to claim 1, wherein said detachable tension means is a hook or pile fastener strap.

3. A mattress system according to claim 1, wherein the upper mattress body has a pair of loops on its edge, one on either side of the cutout and the detachable tension means is a hook and pile fastener strap, the ends of which pass through the loops and are folded back onto the strap and detachably contacted therewith.

* * * * *